US009135670B2

(12) United States Patent
Mayer

(10) Patent No.: US 9,135,670 B2
(45) Date of Patent: Sep. 15, 2015

(54) OPERATIONAL RELIABILITY SYSTEMS AND METHODS

(71) Applicant: US Airways, Inc., Tempe, AZ (US)

(72) Inventor: Chip Mayer, Montclair, VA (US)

(73) Assignee: US Airways, Inc., Tempe, AZ (US)

( * ) Notice: Subject to any disclaimer, the term of this patent is extended or adjusted under 35 U.S.C. 154(b) by 0 days.

(21) Appl. No.: 13/966,723

(22) Filed: Aug. 14, 2013

(65) Prior Publication Data

US 2015/0051824 A1 Feb. 19, 2015

(51) Int. Cl.
*G08G 5/00* (2006.01)
*G06Q 50/30* (2012.01)

(52) U.S. Cl.
CPC ..... *G06Q 50/30* (2013.01)

(58) Field of Classification Search
CPC ..... G06Q 10/06; G06Q 10/047; G06Q 10/02; G06Q 50/30; G01C 23/00; H04W 4/028
USPC ..... 701/120, 3, 528, 10, 467, 529; 342/63; 705/5; 73/178 R
See application file for complete search history.

(56) References Cited

U.S. PATENT DOCUMENTS

| | | | | |
|---|---|---|---|---|
| 6,134,500 | A * | 10/2000 | Tang et al. | 701/528 |
| 6,580,990 | B2 * | 6/2003 | Wager et al. | 701/43 |
| 7,705,968 | B2 * | 4/2010 | Nagasaka et al. | 355/72 |
| 8,700,440 | B1 * | 4/2014 | Ande et al. | 705/7.22 |
| 2009/0240517 | A1 * | 9/2009 | Pelter | 705/1 |
| 2012/0185353 | A1 * | 7/2012 | Goel | 705/26.5 |
| 2013/0046422 | A1 * | 2/2013 | Cabos | 701/3 |
| 2013/0144517 | A1 * | 6/2013 | Kickbusch | 701/119 |
| 2013/0261956 | A1 * | 10/2013 | Marks | 701/425 |

* cited by examiner

*Primary Examiner* — Marthe Marc-Coleman
(74) *Attorney, Agent, or Firm* — Snell & Wilmer L.L.P.

(57) ABSTRACT

An operational reliability system includes a flight grouping module, a block modification module, and a pairing optimizer. The system evaluates potential modifications to scheduled flight block time and quantifies associated changes in on-time performance $B_0$. The system also evaluates the impact of block modifications to headcount, regulatory compliance, operating expenses, and so forth. Via use of the operational reliability system, compliance with external regulations, for example Federal Aviation Regulations (FAR), may be achieved with a higher degree of probability.

10 Claims, 7 Drawing Sheets

OPERATIONAL RELIABILITY SYSTEMS AND METHODS

TECHNICAL FIELD

The present disclosure generally relates to operational reliability, and more particularly, to analysis methods and tools suitable for use in crew planning.

BACKGROUND

Transportation industries (e.g., airlines) often operate under regulatory guidelines related to, among others, flight and duty time limitations, rest requirements, fitness for duty requirements, and the like. These guidelines can vary over time. On one hand, compliance with updated guidelines may be achieved with revisions to staffing approaches, flight schedules, and/or the like. On the other hand, such revisions can be time-consuming, lead to reduced revenue, increased staffing expenses, and otherwise present organizational challenges. Accordingly, improved approaches for operating in accordance with regulatory guidelines (e.g., Federal Aviation Regulations and/or the like) remain desirable.

SUMMARY

In an embodiment, a method comprises obtaining, by a processor for operational reliability, a block file comprising historical information for a plurality of flight groups. Each flight group has a scheduled block time and a historical on-time performance $B_0$. The method further comprises determining, by the processor, a modified block time for each flight group; and generating, by the processor, a modified block file containing the modified block time for each flight group.

In another embodiment, a non-transitory computer-readable storage medium has computer-executable instructions stored thereon that, in response to execution by a processor for operational reliability, causes the processor to perform operations comprising obtaining, by a processor for operational reliability, a block file comprising historical information for a plurality of flight groups, each flight group having a scheduled block time and a historical on-time performance $B_0$; determining, by the processor, a modified block time for each flight group; and generating, by the processor, a modified block file containing the modified block time for each flight group.

BRIEF DESCRIPTION OF THE DRAWINGS

With reference to the following description, appended claims, and accompanying drawings:

DETAILED DESCRIPTION

Figure 1A:
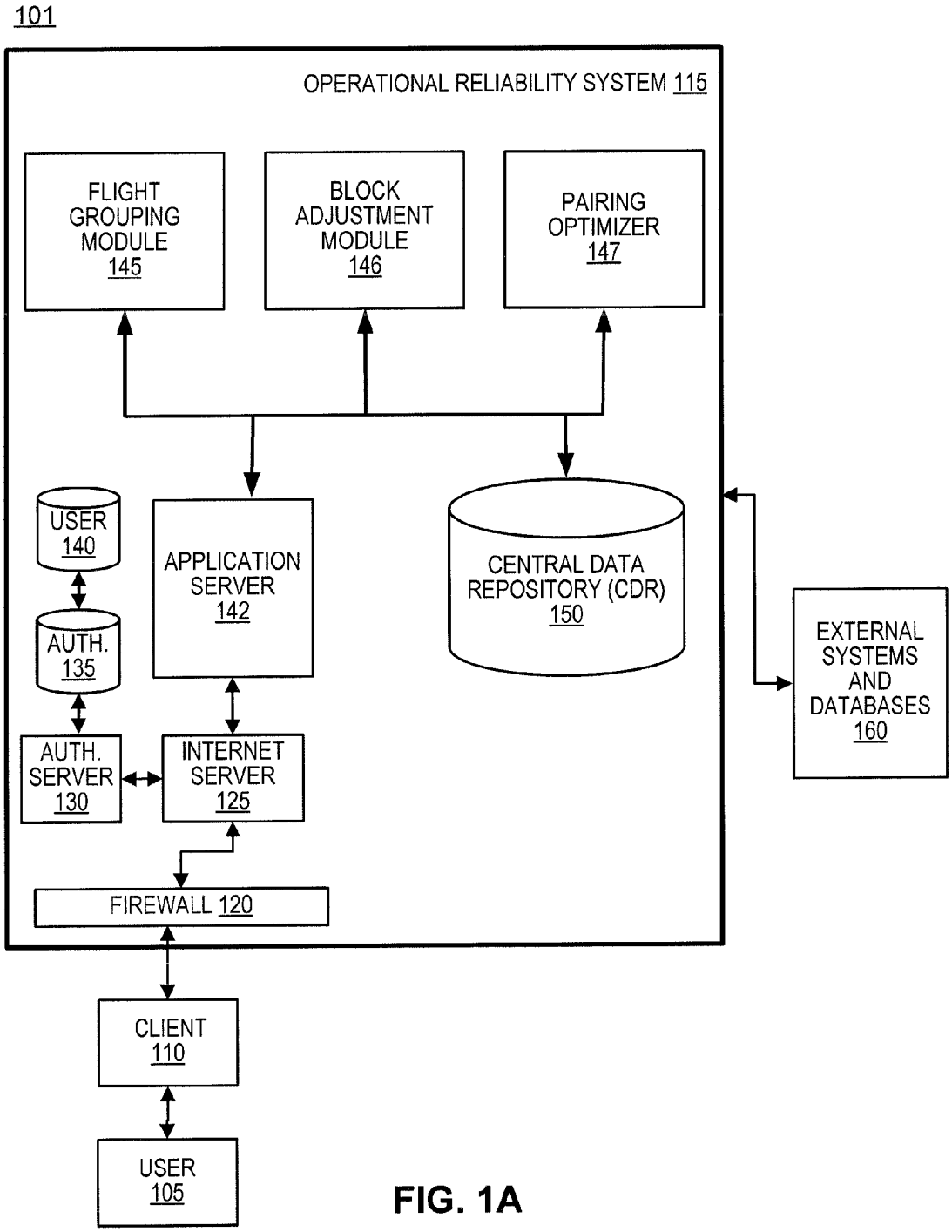
FIG. 1A is a block diagram illustrating exemplary operational reliability system components, in accordance with various embodiments.

The following description is of various embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the present disclosure or appended claims.

For the sake of brevity, conventional techniques for data management, computer networking, software application development, forecasting, block adjustment, operations management, statistical analysis, and other aspects of exemplary systems and methods (and components thereof) and/or the like, may not be described in detail herein. Furthermore, the connecting lines shown in various figures contained herein are intended to represent exemplary functional relationships and/or physical or communicative couplings between various elements. It should be noted that many alternative or additional functional relationships or physical or communicative connections may be present in a practical operational reliability system.

Airlines continually face challenges associated with the efficient planning, scheduling and utilization of assets (e.g., aircraft, flight crews, cabin crews, and/or the like). Additionally, federal regulations (e.g., Federal Aviation Regulation (FAR) 117) govern the approaches an airline may permissibly implement, for example by prescribing flight and duty limitations and rest requirements for crew members. Compliance with these limitations, particularly when these limitations are made stricter, can impose significant costs on an airline. In particular, while weather and other factors can impose significant variability in airline flight duration and hence variability in lineholder hours logged for a particular day, the need for regulatory compliance does not vary. Accordingly, it remains desirable to provide improved methods and systems for operational reliability, for example in order to reduce risk of regulatory violations while limiting additional expenses incurred in connection with the same.

Prior approaches to operational reliability typically employed only a single global buffer for a lineholder. In other words, a lineholder's scheduled flight time, duty time, and rest time were considered monolithically when determining an appropriate buffer to ensure compliance with regulatory guidelines (while allowing for daily variability in actual flight performance and thus actual flight duty time for that workday). Additionally, prior regulatory approaches were more flexible, reducing the need for aggressive buffering to maintain compliance.

In contrast, features of the present disclosure are suitable for use in connection with stricter regulatory schemes, for example wherein hard limits on flight duty time are imposed. Additionally, principles of the present disclosure contemplate buffering flight time, rest time, and flight duty time interdependently, in order to achieve improved regulatory compliance outcomes while limiting additional lineholder expenses.

In accordance with various embodiments, operational reliability systems and methods enable improved regulatory compliance while limiting increased lineholder expense. In various embodiments, rather than applying a single overall buffer, exemplary operational reliability systems and methods are configured to buffer flight time, rest time, and flight duty time interdependently.

While the present disclosure discusses airlines, flights, pilots, flight attendants, and the like for purposes of convenience and illustration, one of skill in the art will appreciate that the operational reliability methods, systems, and tools disclosed herein are broadly applicable, for example to industries that operate under government-imposed or other staffing restrictions and regulations.

Various embodiments employ forecasting, statistical analysis and/or optimization techniques. For more information regarding such techniques refer to, for example: "The Theory and Practice of Revenue Management" (International Series in Operations Research & Management Science) by Kalyan T. Talluri and Garrett J. van Ryzin; "Using Multivariate Statistics (5th Edition)" by Barbara G. Tabachnick and Linda S. Fidell; and "Introduction to Operations Research" by Friedrich S. Hiller and Gerald J. Lieberman, McGraw-Hill 7th edition, Mar. 22, 2002; the contents of which are each hereby incorporated by reference in their entireties for any purpose.

In various embodiments, exemplary operational reliability systems include a user interface ("UI"), software modules, logic engines, various databases, interfaces to systems and tools, and/or computer networks. While exemplary operational reliability systems may contemplate upgrades or reconfigurations of existing processing systems, changes to existing databases and system tools are not necessarily required by principles of the present disclosure.

The benefits provided by features of the present disclosure include, for example, reduced flight cancellations, reduced staffing requirements, lower payroll costs, increased planning and operational efficiency, increased employee morale, and the like. For example, a crew planning organization benefits from improved forecasting accuracy and resulting decreased payroll expenses.

As used herein, an "entity" may include any individual, software program, business, organization, government entity, web site, system, hardware, and/or any other entity. A "user" may include any entity that interacts with a system and/or participates in a process.

Turning now to FIG. 1A, in accordance with various embodiments, a user 105 may perform tasks such as requesting, retrieving, receiving, updating, analyzing and/or modifying data. User 105 may also perform tasks such as initiating, manipulating, interacting with or using a software application, tool, module or hardware, and initiating, receiving or sending a communication. User 105 may interface with Internet server 125 via any communication protocol, device or method discussed herein, known in the art, or later developed. User 105 may be, for example, a member of a crew planning organization, a member of an operations research or systems analysis organization, a downstream system, an upstream system, a third-party system, a system administrator, and/or the like.

In various embodiments, a system 101 may include a user 105 interfacing with an operational reliability system 115 by way of a client 110. Operational reliability system 115 may be a partially or fully integrated system comprised of various subsystems, modules and databases. Client 110 comprises any hardware and/or software suitably configured to facilitate entering, accessing, requesting, retrieving, updating, analyzing and/or modifying data. The data may include operational data (e.g., schedules, resources, routes, operational alerts, weather, etc.), human resource data (for example, on-duty and off-duty days for pilots and flight attendants), passenger data, cost data, forecasts, historical data, verification data, asset (e.g., airplane) data, inventory (e.g., airplane seat) data, legal/regulatory data, authentication data, demographic data, transaction data, or any other suitable information discussed herein.

Client 110 includes any device (e.g., a computer), which communicates, in any manner discussed herein, with operational reliability system 115 via any network or protocol discussed herein. Browser applications comprise Internet browsing software installed within a computing unit or system to conduct online communications and transactions. These computing units or systems may take the form of personal computers, mobile phones, personal digital assistants, mobile email devices, tablets, laptops, notebooks, hand-held computers, portable computers, kiosks, and/or the like. Practitioners will appreciate that client 110 may or may not be in direct contact with operational reliability system 115. For example, client 110 may access the services of operational reliability system 115 through another server, which may have a direct or indirect connection to Internet server 125. Practitioners will further recognize that client 110 may present interfaces associated with a software application (e.g., analytic software) or module that are provided to client 110 via application graphical user interfaces (GUIs) or other interfaces and are not necessarily associated with or dependent upon Internet browsers or internet specific protocols.

User 105 may communicate with operational reliability system 115 through a firewall 120, for example to help ensure the integrity of operational reliability system 115 components. Internet server 125 may include any hardware and/or software suitably configured to facilitate communications between the client 110 and one or more operational reliability system 115 components.

Firewall 120, as used herein, may comprise any hardware and/or software suitably configured to protect operational reliability system 115 components from users of other networks. Firewall 120 may reside in varying configurations including stateful inspection, proxy based and packet filtering, among others. Firewall 120 may be integrated as software within Internet server 125, any other system 101 component, or may reside within another computing device or may take the form of a standalone hardware component.

Authentication server 130 may include any hardware and/or software suitably configured to receive authentication credentials, encrypt and decrypt credentials, authenticate credentials, and/or grant access rights according to pre-defined privileges associated with the credentials. Authentication server 130 may grant varying degrees of application and/or data level access to users based on information stored within authentication database 135 and user database 140. Application server 142 may include any hardware and/or software suitably configured to serve applications and data to a connected client 110.

In accordance with various embodiments, operational reliability system 115 is usable to generate suggested buffers for crew staffing, manage crew staffing strategy, evaluate risk associated with a particular crew staffing strategy, generate inputs to other forecasting systems, and/or the like. Continuing to reference FIG. 1A, operational reliability system 115 allows communication with central data repository (CDR) 150, and with various other databases, tools, UIs and systems, for example external systems and databases 160. Such systems include, for example, airline scheduling systems, passenger booking and reservations systems, human resource systems, revenue management systems, inventory systems, and/or the like.

Operational reliability system 115 components may be interconnected and communicate with one another to allow for a completely integrated operational reliability system. In various embodiments, operational reliability system 115 formulates suggested block modifications (and/or associated expense and/or revenue consequences) at a per-flight level and/or a flight group level. Crew scheduling systems may generate bidlines and/or otherwise make staffing decisions based at least in part upon the output of operational reliability system 115.

In various embodiments, operational reliability system 115 modules (e.g., flight grouping module 145, block adjustment module 146, and/or pairing optimizer 147) are software modules configured to enable online functions such as sending and receiving messages, receiving query requests, configuring responses, dynamically configuring user interfaces, requesting data, receiving data, displaying data, executing complex processes, calculations, forecasts, mathematical techniques, workflows and/or algorithms, prompting user 105, verifying user responses, authenticating the user, initiating operational reliability system 115 processes, initiating other software modules, triggering downstream systems and processes, encrypting and decrypting, and/or the like. Additionally, operational reliability system 115 modules may include any hardware and/or software suitably configured to receive requests from client 110 via Internet server 125 and application server 142.

Operational reliability system 115 modules may be further configured to process requests, execute transactions, construct database queries, and/or execute queries against databases within system 101 (e.g., central data repository ("CDR") 150), external data sources and/or temporary databases. In various embodiments, one or more operational reliability system 115 modules may be configured to execute application programming interfaces in order to communicate with a variety of messaging platforms, such as email systems, wireless communications systems, mobile communications systems, multimedia messaging service ("MMS") systems, short messaging service ("SMS") systems, and the like.

Operational reliability system 115 modules may be configured to exchange data with other systems and application modules, for example, a scheduling system that generates monthly work/flight schedules for lineholders in order to cover a particular airline flight schedule, a flight schedule system, a crew bid system, and/or the like. In various embodiments, operational reliability system 115 modules may be configured to interact with other system 101 components to perform complex calculations, retrieve additional data, format data into reports, create XML representations of data, construct markup language documents, construct, define or control UIs, and/or the like. Moreover, operational reliability system 115 modules may reside as standalone systems or tools or may be incorporated with the application server 142 or any other operational reliability system 115 component as program code. As one of ordinary skill in the art will appreciate, operational reliability system 115 modules may be logically or physically divided into various subcomponents, such as a workflow engine configured to evaluate predefined rules and to automate processes.

In addition to the components described above, operational reliability system 115 may further include one or more of the following: a host server or other computing systems including a processor for processing digital data; a memory coupled to the processor for storing digital data; an input digitizer coupled to the processor for inputting digital data; an application program stored in the memory and accessible by the processor for directing processing of digital data by the processor; a display device coupled to the processor and memory for displaying information derived from digital data processed by the processor; a plurality of databases, and/or the like.

As will be appreciated by one of ordinary skill in the art, one or more system 101 components may be embodied as a customization of an existing system, an add-on product, upgraded software, a stand-alone system (e.g., kiosk), a distributed system, a method, a data processing system, a device for data processing, and/or a computer program product. Accordingly, individual system 101 components may take the form of an entirely software embodiment, an entirely hardware embodiment, or an embodiment combining aspects of both software and hardware. Furthermore, individual system 101 components may take the form of a computer program product on a computer-readable storage medium having computer-readable program code means embodied in the storage medium. Any suitable computer-readable storage medium may be utilized, including magnetic storage devices (e.g., hard disks), optical storage devices, (e.g., DVD-ROM, CD-ROM, etc.), electronic storage devices (e.g., flash memory), and/or the like.

Client 110 may include an operating system (e.g., Windows, UNIX, Linux, Solaris, MacOS, iOS, Android, Windows Mobile OS, Windows CE, Palm OS, Symbian OS, Blackberry OS, J2ME, etc.) as well as various conventional support software and drivers typically associated with mobile devices and/or computers. Client 110 may be in any environment with access to any network, including both wireless and wired network connections. In various embodiments, access is through a network or the Internet through a commercially available web-browser software package. Client 110 and operational reliability system 115 components may be independently, separately or collectively suitably coupled to the network via data links which include, for example, a connection to an Internet Service Provider (ISP) over the local loop as is typically used in connection with standard wireless communications networks and/or methods, such as modem communication, cable modem, satellite networks, ISDN, digital subscriber line (DSL), and/or the like. In various embodiments, any portion of client 110 may be partially or fully connected to a network using a wired ("hard wire") connection. As those skilled in the art will appreciate, client 110 and/or any of the system components may include wired and/or wireless portions.

In various embodiments, components, modules, and/or engines of operational reliability system 115 may be implemented as micro-applications or micro-apps. Micro-apps are typically deployed in the context of a mobile operating system, including for example, a Palm mobile operating system, a Windows mobile operating system, an Android Operating System, Apple iOS, a Blackberry operating system, and the like. The micro-app may be configured to leverage the resources of the larger operating system and associated hardware via a set of predetermined rules which govern the operations of various operating systems and hardware resources. For example, where a micro-app desires to communicate with a device or network other than the mobile device or mobile operating system, the micro-app may leverage the communication protocol of the operating system and associated device hardware under the predetermined rules of the mobile operating system. Moreover, where the micro-app desires an input from a user, the micro-app may be configured to request a response from the operating system which monitors various hardware components and then communicates a detected input from the hardware to the micro-app.

Internet server 125 may be configured to transmit data to client 110, for example within markup language documents. "Data" may include encompassing information such as commands, messages, transaction requests, queries, files, data for storage, and/or the like in digital or any other form. Internet server 125 may operate as a single entity in a single geographic location or as separate computing components located together or in separate geographic locations. Further, Internet server 125 may provide a suitable web site or other Internet-based graphical user interface, which is accessible by users (such as user 105). In various embodiments, Microsoft Internet Information Server (IIS), Microsoft Transaction Server (MTS), and Microsoft SQL Server, are used in conjunction with a Microsoft operating system, Microsoft NT web server software, a Microsoft SQL Server database system, and a Microsoft Commerce Server. In various embodiments, the well-known "LAMP" stack (Linux, Apache, MySQL, and PHP/Perl/Python) are used to enable operational reliability system 115. Additionally, components such as Access or Microsoft SQL Server, Oracle, Sybase, InterBase, etc., may be used to provide an Active Data Object (ADO) compliant database management system.

Like Internet server 125, application server 142 may communicate with any number of other servers, databases and/or components through any means known in the art. Further, application server 142 may serve as a conduit between client 110 and the various systems and components of operational reliability system 115. Internet server 125 may interface with application server 142 through any means known in the art including a LAN/WAN, for example. Application server 142 may further invoke software modules, such as flight grouping module 145, block adjustment module 146, and/or pairing, optimizer 14'7, automatically or in response to user 105 requests.

Any of the communications, inputs, storage, databases or displays discussed herein may be facilitated through a web site having web pages. The term "web page" as it is used herein is not meant to limit the type of documents and applications that may be used to interact with the user. For example, a typical web site may include, in addition to standard HTML documents, various forms, Java applets, JavaScript, active server pages (ASP), common gateway interface scripts (CGI), Flash files or modules, FLEX, ActionScript, extensible markup language (XML), dynamic HTML, cascading style sheets (CSS), helper applications, plug-ins, and/or the like. A server may include a web service that receives a request from a web server, the request including a URL (e.g., http://yahoo.com/) and/or an interne protocol ("IP") address. The web server retrieves the appropriate web pages and sends the data or applications for the web pages to the IP address. Web services are applications that are capable of interacting with other applications over a communications means, such as the Internet. Web services are typically based on standards or protocols such as XML, SOAP, WSDL and UDDI. Web services methods are well known in the art, and are covered in many standard texts. See, e.g., Alex Nghiem, IT Web Services: A Roadmap for the Enterprise (2003).

Continuing to reference FIG. 1A, illustrated are databases that are included in various embodiments. An exemplary list of various databases used herein includes: an authentication database 135, a user database 140, CDR 150 and/or other databases that aid in the functioning of the system. As practitioners will appreciate, while depicted as separate and/or independent entities for the purposes of illustration, databases residing within system 101 may represent multiple hardware, software, database, data structure and networking components. Furthermore, embodiments are not limited to the databases described herein, nor do embodiments necessarily utilize each of the disclosed databases.

Authentication database 135 may store information used in the authentication process such as, for example, user identifiers, passwords, access privileges, user preferences, user statistics, and the like. User database 140 maintains user information and credentials for operational reliability system 115 users (e.g., user 105).

In various embodiments, CDR 150 is a data repository that may be configured to store a wide variety of comprehensive data for operational reliability system 115. While depicted as a single logical entity in FIG. 1A, those of skill in the art will appreciate that CDR 150 may, in various embodiments, consist of multiple physical and/or logical data sources. In various embodiments, CDR 150 stores operational data, schedules, resource data, asset data, inventory data, personnel information, routes and route plans, station (e.g., airports or other terminals) data, operational alert data, weather information, passenger data, reservation data, cost data, optimization results, booking class data, forecasts, historical data, verification data, authentication data, demographic data, legal data, regulatory data, transaction data, security profiles, access rules, content analysis rules, audit records, predefined rules, process definitions, financial data, and the like.

Any databases discussed herein may include relational, hierarchical, graphical, or object-oriented structure and/or any other database configurations. Common database products that may be used to implement the databases include DB2 by IBM (Armonk, N.Y.), various database products available from Oracle Corporation (Redwood Shores, Calif.), Microsoft Access or Microsoft SQL Server by Microsoft Corporation (Redmond, Wash.), My SQL by My SQL AB (Uppsala, Sweden), or any other suitable database product. Moreover, the databases may be organized in any suitable manner, for example, as data tables or lookup tables. Each record may be a single file, a series of files, a linked series of data fields or any other data structure. Association of certain data may be accomplished through any desired data association technique such as those known or practiced in the art. For example, the association may be accomplished either manually or automatically. Automatic association techniques may include, for example, a database search, a database merge, GREP, AGREP, SQL, using a key field in the tables to speed searches, sequential searches through all the tables and files, sorting records in the file according to a known order to simplify lookup, and/or the like. The association step may be accomplished by a database merge function, for example, using a "key field" in pre-selected databases or data sectors. Various database tuning steps are contemplated to optimize database performance. For example, frequently used files such as indexes may be placed on separate file systems to reduce In/Out ("I/O") bottlenecks.

One skilled in the art will also appreciate that, for security reasons, any databases, systems, devices, servers or other components of system 101 may consist of any combination thereof at a single location or at multiple locations, wherein each database or system includes any of various suitable security features, such as firewalls, access codes, encryption, decryption, compression, decompression, and/or the like.

The systems and methods may be described herein in terms of functional block components, screen shots, optional selections and various processing steps. It should be appreciated that such functional blocks may be realized by any number of hardware and/or software components configured to perform the specified functions. For example, the system may employ various integrated circuit components, e.g., memory elements, processing elements, logic elements, look-up tables, and the like, which may carry out a variety of functions under the control of one or more microprocessors or other control devices. Similarly, the software elements of the system may be implemented with any programming or scripting language such as C, C++, C#, Java, JavaScript, Flash, ActionScript, FLEX, VBScript, Macromedia Cold Fusion, COBOL, Microsoft Active Server Pages, assembly, PERL, SAS, PHP, awk, Python, Visual Basic, SQL Stored Procedures, PL/SQL, any UNIX shell script, and/or extensible markup language (XML) or the like, with the various algorithms being implemented with any combination of data structures, objects, processes, routines or other programming elements. Further, it should be noted that the system may employ any number of conventional techniques for data transmission, signaling, data processing, network control, and the like. Still further, the system may be used to detect or prevent security issues with a client-side scripting language, such as JavaScript, VBScript or the like.

Software elements may be loaded onto a general purpose computer, special purpose computer, or other programmable data processing apparatus to produce a machine, such that the instructions that execute on the computer or other programmable data processing means for implementing the functions specified in the flowchart block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function specified herein or in flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware-based computer systems which perform the specified functions or steps, or suitable combinations of special purpose hardware and computer instructions. Further, illustrations of the process flows and the descriptions thereof may make reference to user windows, web pages, web sites, web forms, prompts, etc. Practitioners will appreciate that the illustrated steps described herein may comprise any number of configurations including the use of windows, web pages, web forms, popup windows, prompts and/or the like. It should be further appreciated that the multiple steps as illustrated and described may be combined into single web pages and/or windows but have been expanded for the sake of simplicity. In other cases, steps illustrated and described as single process steps may be separated into multiple web pages and/or windows but have been combined for simplicity.

With continued reference to FIG. 1A, in various embodiments, user 105 logs onto an application (e.g., a module) and Internet server 125 may invoke an application server 142. Application server 142 invokes logic in an operational reliability system 115 module by passing parameters relating to user's 105 requests for data. Operational reliability system 115 manages requests for data from operational reliability system 115 modules and/or communicates with system 101 components. Transmissions between user 105 and Internet server 125 may pass through a firewall 120 to help ensure the integrity of operational reliability system 115 components. Practitioners will appreciate that exemplary embodiments may incorporate any number of security schemes or none at all. In various embodiments, Internet server 125 receives requests from client 110 and interacts with various other system 101 components to perform tasks related to requests from client 110.

Internet server 125 may invoke an authentication server 130 to verify the identity of user 105 and assign roles, access rights and/or permissions to user 105. In order to control access to the application server 142 or any other component of operational reliability system 115, Internet server 125 may invoke an authentication server 130 in response to user 105 submissions of authentication credentials received at Internet server 125. In response to a request to access system 101 being received from Internet server 125, Internet server 125 determines if authentication is required and transmits a prompt to client 110. User 105 enters authentication data at client 110, which transmits the authentication data to Internet server 125. Internet server 125 passes the authentication data to authentication server 142 which queries the user database 140 for corresponding credentials. In response to user 105 being authenticated, user 105 may access various applications and their corresponding data sources.

With reference now to FIGS. 1A through 2F, in various embodiments operational reliability system 115 and/or method 200 utilizes an optimization model for staffing which balances improvements in reliability with increases in cost. In an embodiment, operational reliability system 115 utilizes historical information for a flight or group of related flights to determine a suitable buffer for insuring regulatory compliance. Consequently, operational reliability system 115 allows users (for example, crew planners) to establish an acceptable likelihood of regulatory compliance for a particular staffing approach, while avoiding unnecessary staffing expenses associated with overstaffing (or underutilizing existing staff).

Figure 1B:
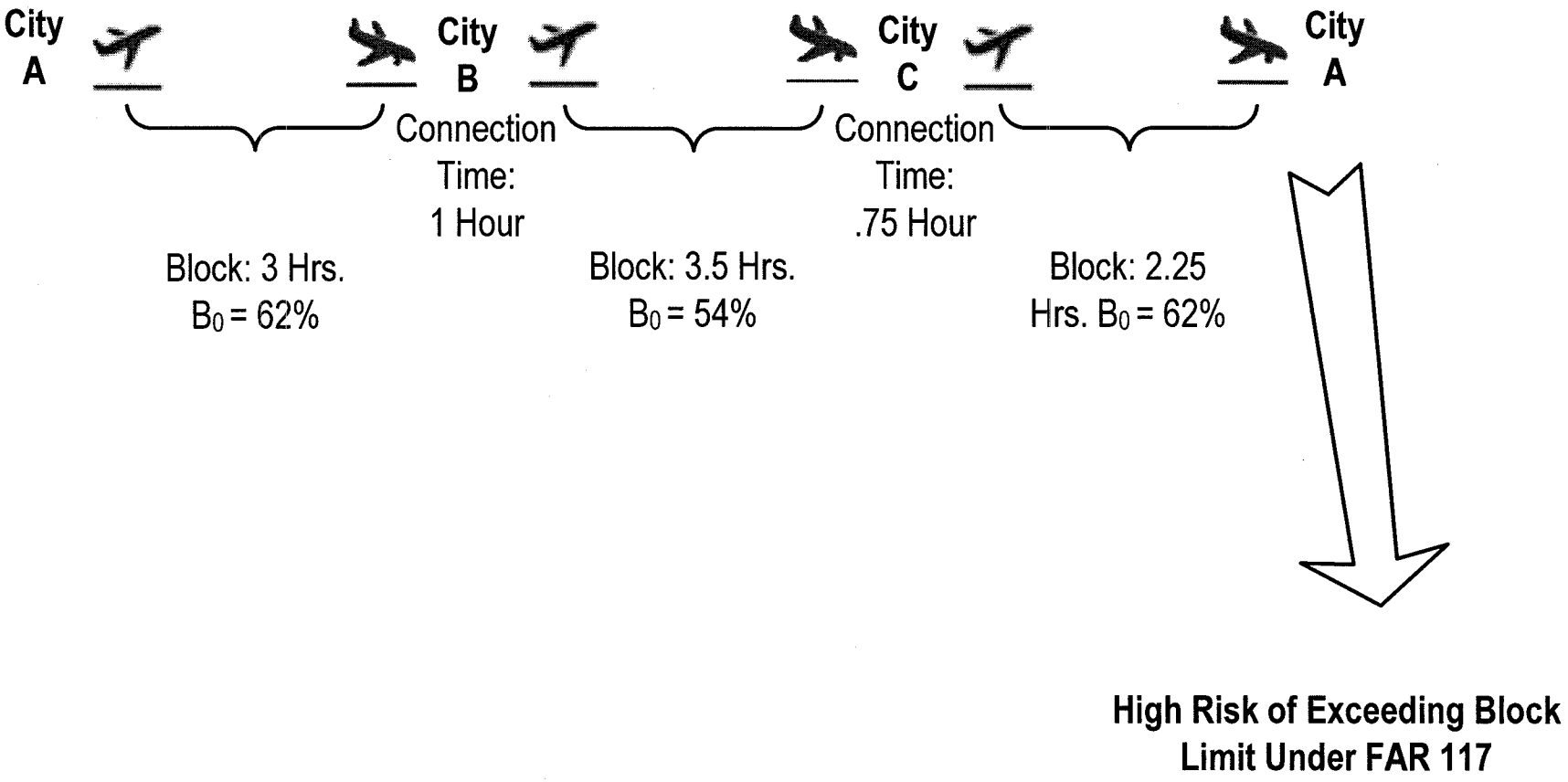
FIG. 1B illustrates an exemplary flight schedule for a lineholder in accordance with various embodiments.

With reference now to FIG. 1B, an airline employee (e.g., a pilot, flight crew member, or the like) is typically scheduled to work a series of flights during a particular flight duty period. In the exemplary schedule illustrated in FIG. 1B, a crew member is scheduled to work three flights having a combined scheduled flight block time of 8.75 hours and a combined scheduled connection time of 1.75 hours, for a total scheduled block time of 10.5 hours in the exemplary flight duty period. However, in FIG. 1B it can be seen that each flight leg in the employee schedule has a different on-time performance $B_O$, which is the percentage of time that, for a given flight, the scheduled block time is less than or equal to the actual block time. Thus, for example, it can be seen that the flight from City B to City C has a scheduled block time of 3.5 hours; however, this block time is achieved only 54% of the time (and thus, the actual block time for this flight is greater than 3.5 hours 46% of the time). Because the flights in this exemplary employee schedule are highly variable with respect to block time, the employee has a heightened risk of exceeding a regulatory limit for flight duty time (for example, as detailed in FAR 117).

Accordingly, in various embodiments operational reliability system 115 is configured to revise and/or modify block times for a flight or series of flights, rest periods, or flight duty times. In this manner, operational reliability system 115 is usable to determine a modification to a scheduled block time for a flight (or series of flights) in order to obtain a desired $B_0$. Moreover, operational reliability system 115 is configured to obtain a desired $B_0$ in an efficient manner; stated another way, operational reliability system 115 is configured to obtain a desired $B_0$ while limiting increased staffing expenses. Stated differently, operational reliability system 115 may be configured to provide an answer to the question, "How much scheduled block time should be allocated to a particular flight group in order to achieve a desired predicted level of on-time performance?" and the question, "What is the expense associated with the additional block time?"

By way of comparison, prior approaches to achieving operational reliability, for example a global buffer approach, often result in buffering for flights that do not require it, resulting in needless on-duty staff time. As a result, these prior approaches tend to cause underutilization of staff and excessive staffing expenses.

Figure 2A:
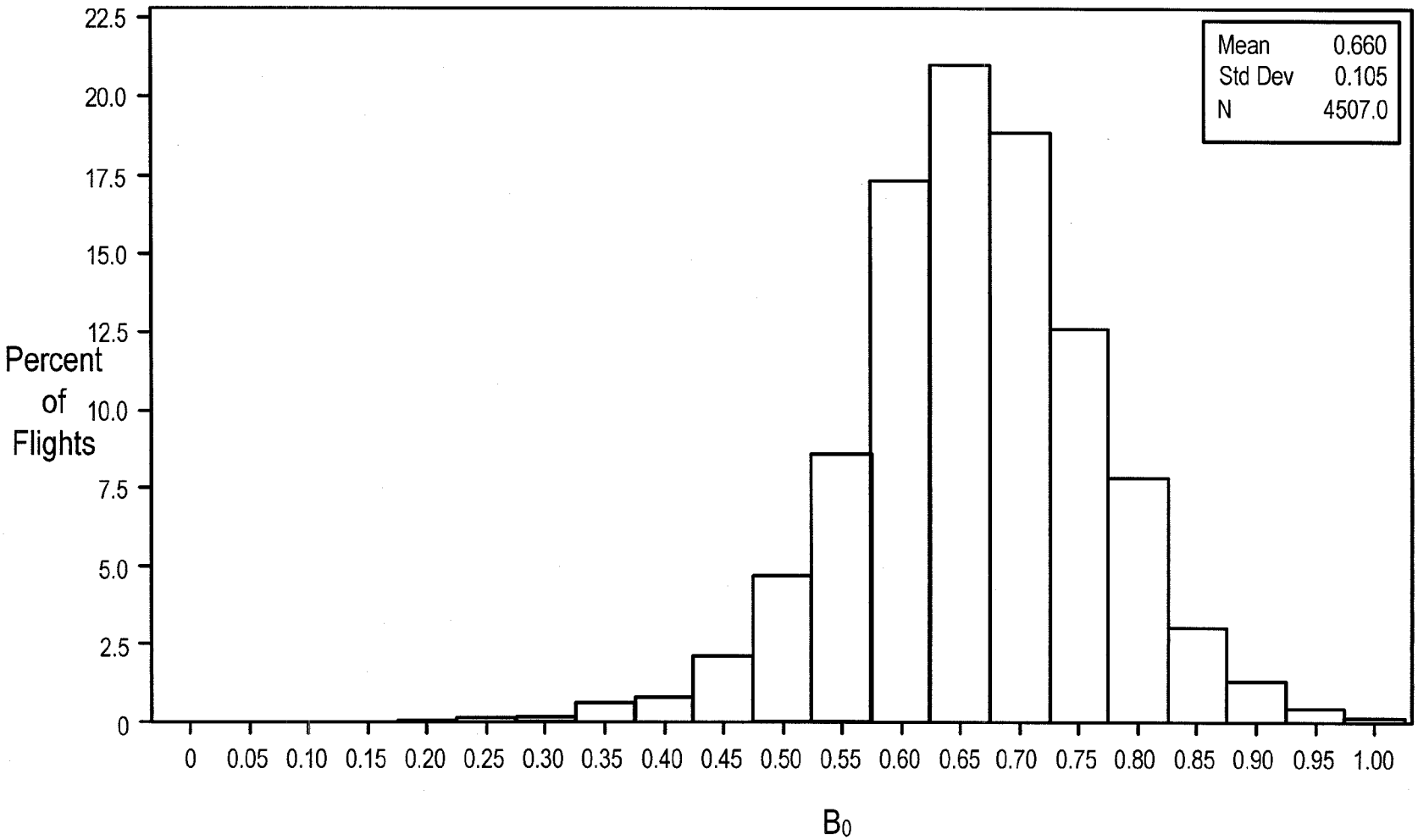
FIG. 2A illustrates an exemplary distribution of historical $B_0$ performance information for airline flights, in accordance with various embodiments.

With reference now to FIG. 2A, an exemplary distribution of historical $B_0$ performance for a group of 4,507 flights is illustrated. For the exemplary flights, it can be seen that the mean $B_0$ has a value of 66% and a standard deviation of 10.5%; the bottom-performing 20% of flights have a $B_0$ of 55% or lower. For these flights with a low $B_0$, utilizing conventional approaches for pairing lineholders with assignments results in significantly increased risk, for example risk of a violation of FAR 117 due to variability in flight time.

Returning now to FIG. 1A, in various embodiments operational reliability system 115 utilizes flight grouping module 145 to group flights for statistical assessment. When data are highly aggregated, trends and meaningful metrics may be obscured and/or lost due to averaging; conversely, when data are highly granular, trends and meaningful metrics may be difficult to analyze due to small sample size, the analysis may be misleading due to inconsistency of data, and statistical techniques may be limited in application. Accordingly, in various embodiments, flight grouping module 145 is configured to group flights via an approach that minimizes (or reduces) variance within the group, maximizes (or increases) variance between the groups, and provides a statistically significant sample size in each group. In an embodiment, flight grouping module 145 groups flights by departure station, arrival station, departure time, day of the week (weekend or weekday), and season (regular, summer, holiday, and so forth). Flight grouping module 145 may group flights by any suitable criteria in order to make statistically significant comparisons between and/or within groups.

Figure 2B:
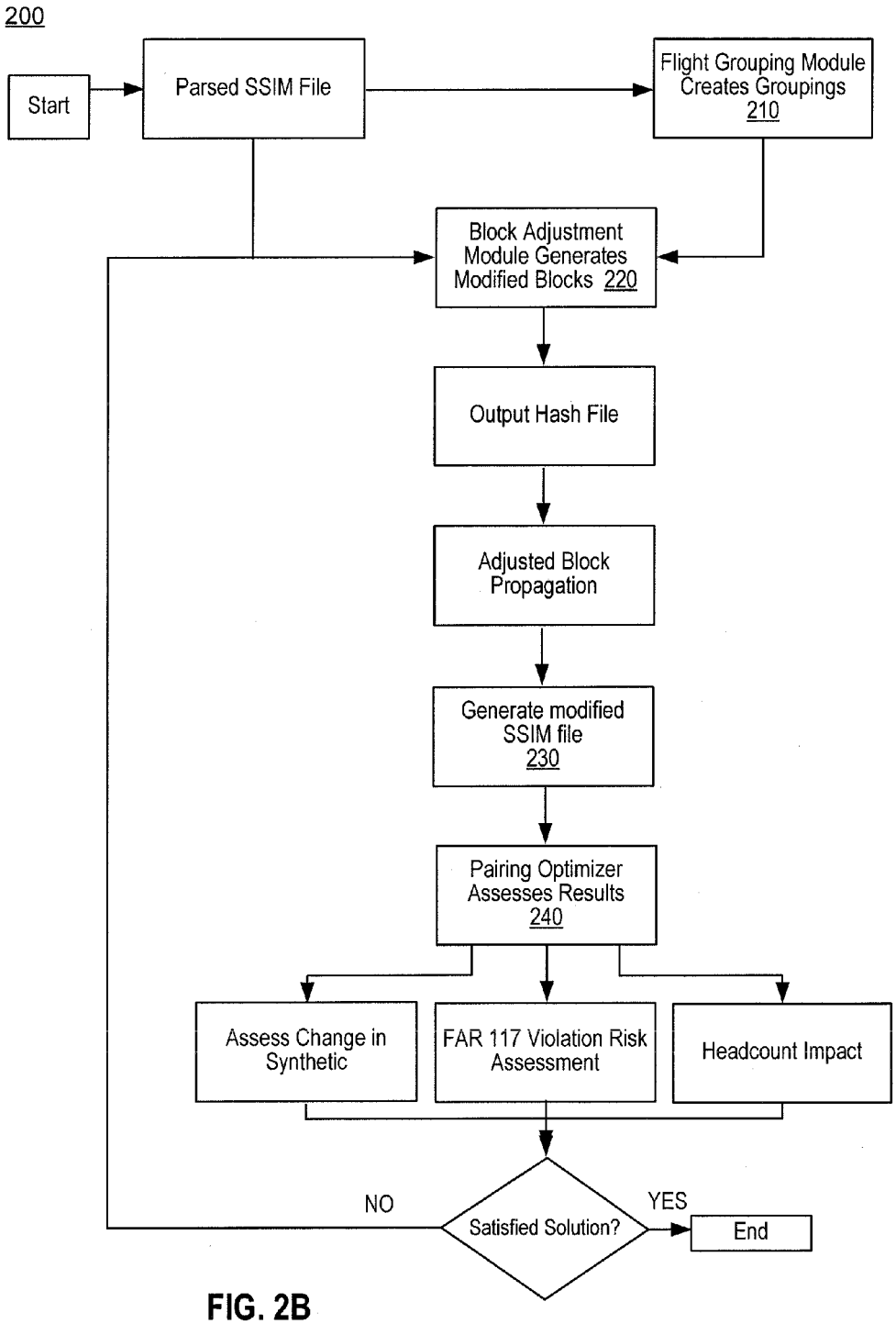
FIG. 2B illustrates an exemplary method for operational reliability, in accordance with various embodiments.
Figure 2C:
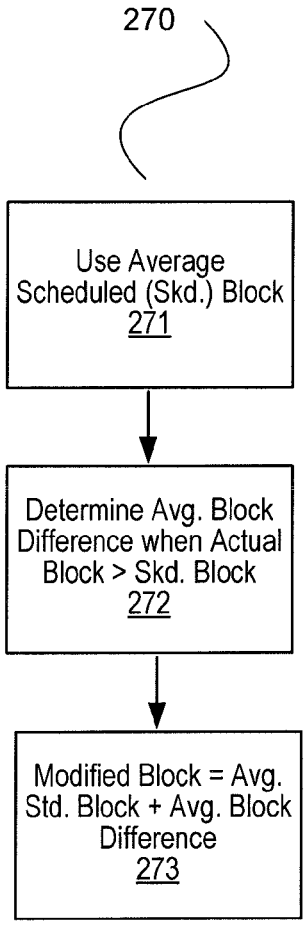
FIGS. 2C and 2D illustrate exemplary methods for block modification, in accordance with various embodiments.

Turning now to FIG. 2B, in various exemplary embodiments, operational reliability system 115 utilizes a method 200 for block modification configured to provide suggested modified block times for a flight or series of flights. A parsed SSIM file is utilized as an input to flight grouping module 145 and block adjustment module 146. The SSIM file may contain, for example, airline flight schedule information, fleet type identifier, arrival time, departure time, flight #, city pair, aircraft next leg information, and so forth. Flight grouping module 145 assesses the SSIM file and generates a set of flight groupings (step 210). Block adjustment module 146 utilizes the SSIM file and the set of flight groupings to generate modified blocks on a per-group basis (step 220) and generate a modified SSIM file incorporating the modified blocks (step 230). The modified SSIM file containing the modified blocks is utilized by pairing optimizer 147 to assess the impact of the proposed modified blocks (step 240), for example the impact on headcount, risk of FAR 117 violation, change in synthetic, and the like.

As used herein, "synthetic" may be understood to be, for a particular crew member, the difference between the actual duty rig time and compensated flight time. For example, if a particular crew member's compensation agreement specifies 1 hour of flight pay for every 2 hours of duty time, and on a particular day that crew member is scheduled to fly 5 hours and is on duty for 12 hours, then for that particular day the crew member will receive 5 hours of flight pay, and one hour of duty rig (i.e., "synthetic") compensation.

If the proposed modified SSIM file is acceptable (for example, to a crew planning organization), the method ends; otherwise, the process is repeated with block adjustment module 146 generating further revised modified blocks for assessment. Method 200 may be iterated until an acceptable solution is reached.

In an embodiment, flight grouping module 145 groups flights via a hashing algorithm. Flight grouping module 145 may generate a hash for a particular station pair, season, week or weekend, etc. Flight history data matching the hash may be utilized by block adjustment module 146 to generate modified bocks for flights matching the hash. Moreover, flight grouping module 145 may be configured to group flights in any statistically suitable manner.

In various embodiments, block adjustment module 146 may employ one or more methods for block modification. In one embodiment, with reference to FIG. 2C, block adjustment module 146 utilizes a block modification method 270. In block modification method 270, the average scheduled block for a group of flights is utilized (step 271). Block adjustment module 146 utilizes historical information to determine, for those instances when the actual block time exceeds the scheduled block time, the average difference between the actual block time and the scheduled block time (step 272). The average difference is added to the average scheduled block time to obtain a modified block time (step 273).

Figure 2D:
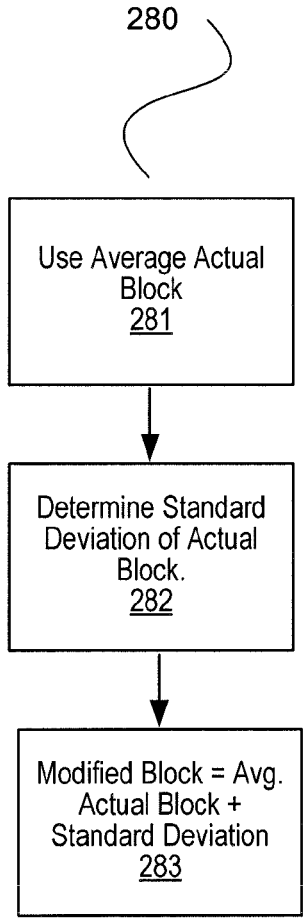

In another embodiment, with reference to FIG. 2D, block adjustment module 146 utilizes a block modification method 280. In block modification method 280, the average actual block time for a group of flights is utilized (step 281). Block adjustment module 146 utilizes historical information to determine the standard deviation of the actual block times for the flights in the group of flights (step 282). The standard deviation is added to the average actual block time to obtain a modified block time (step 283).

Figure 2E:
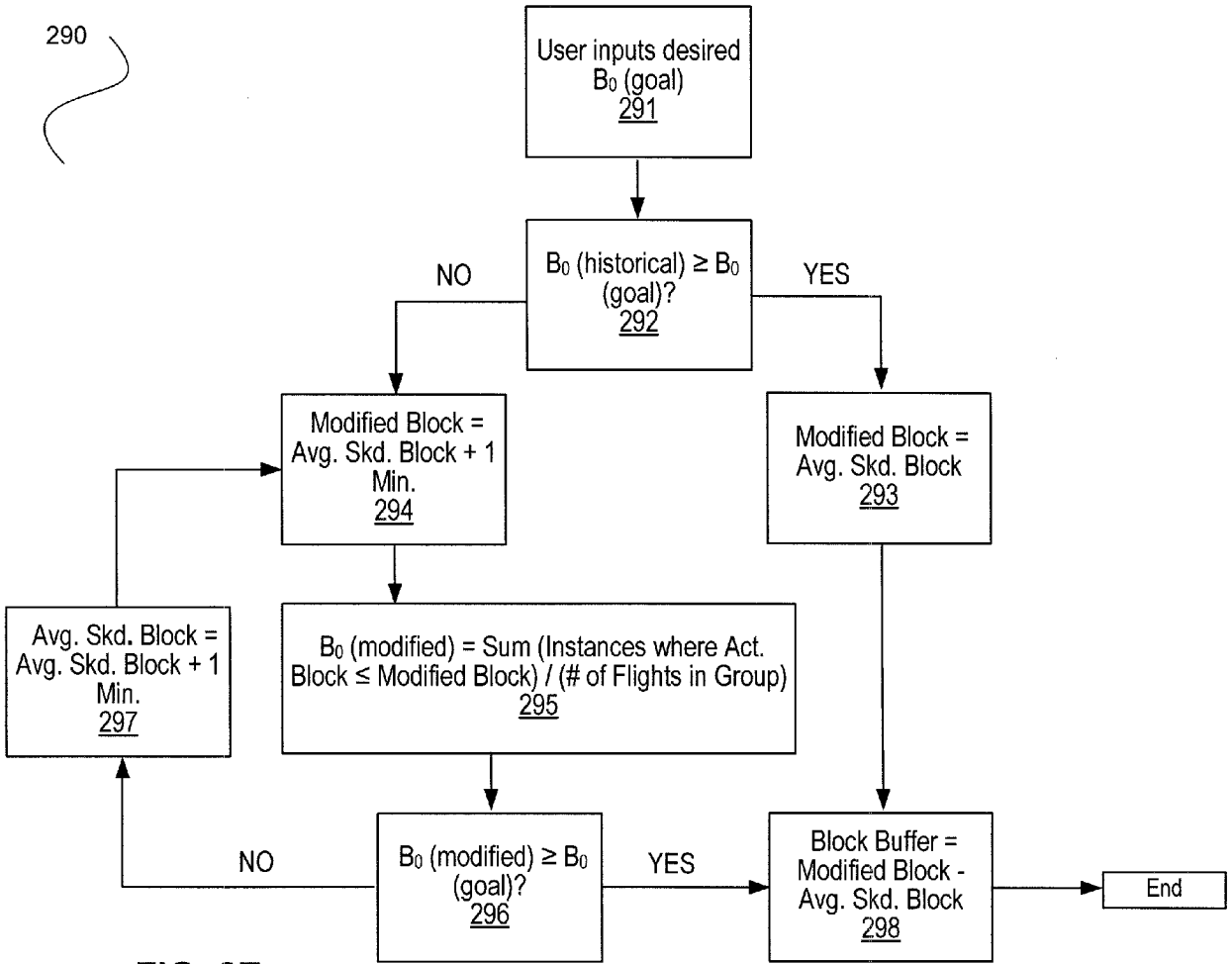
FIG. 2E illustrates an exemplary method for block modification, in accordance with various embodiments.
Figure 2F:
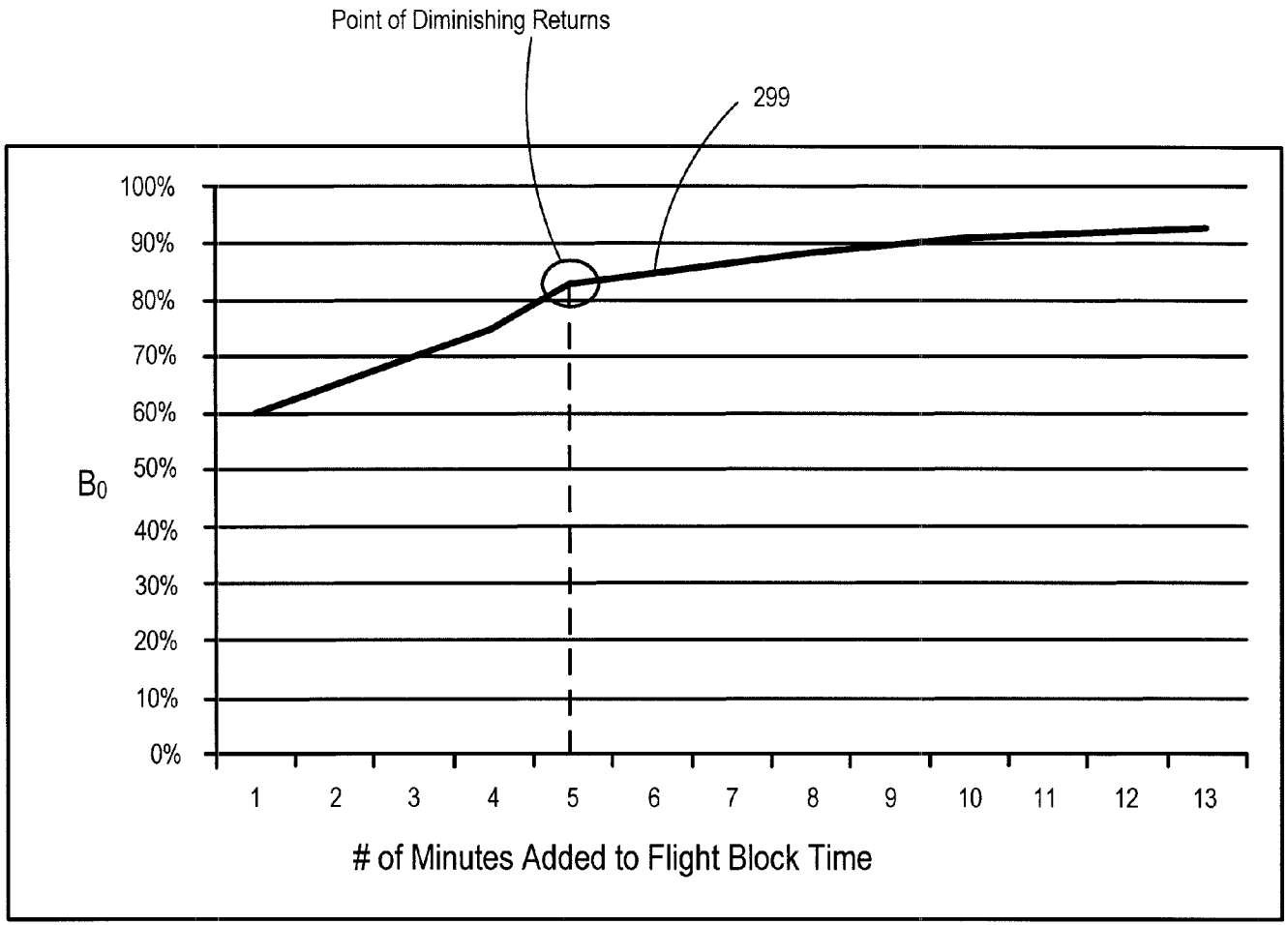
FIG. 2F illustrates exemplary block modification considering a point of diminishing returns, in accordance with various embodiments.

In yet another embodiment, with reference to FIG. 2E, block adjustment module 146 utilizes a goal seeking block modification method 290. In block modification method 290, a user inputs a desired $B_0$ as a goal. Block adjustment module 146 evaluates if historical $B_0$ is greater than or equal to the goal: (i) if YES, the modified block time is set as the average scheduled block time (step 293) and the block buffer is set to the modified block time minus the average scheduled block time (i.e., the block buffer is set to zero—no buffer time was added) (step 298); (ii) if NO, the modified block time is set as the average scheduled block time plus one minute (step 294). Block adjustment module 146 then calculates a modified $B_0$ equal to: the sum of (instances where the actual block time is less than or equal to the modified block time) divided by (the number of flights in the group) (step 295). The modified $B_0$ and desired $B_0$ are evaluated (step 296). If modified $B_0$ is less than the desired $B_0$, the average scheduled block is incremented by one minute, and the process returns to step 294. The process repeats until modified $B_0$ is greater than or equal to the desired $B_0$. At that point, the block buffer is set to the modified block time minus the average scheduled block time (i.e., the block buffer is set to the number of minutes added to achieve the desired $B_0$) (step 298).

Table 1 below illustrates information for three exemplary flights. While principles of the present disclosure are discussed in connection with embodiments related to application of systems and methods for operational reliability to airline flights, the following examples are by way of illustration and not of limitation.

TABLE 1

| | Flight 1 | Flight 2 | Flight 3 |
|---|---|---|---|
| Departure City | BWI | LGA | PHL |
| Arrival City | PHL | DCA | TPA |
| Departure Time | 8:20 AM | 3:30 PM | 5:50 PM |
| Day | Weekday | Weekday | Weekday |
| Season | Regular Season | Regular Season | Regular Season |
| Historical $B_0$ | 47% | 48% | 62% |

Table 2 illustrates application of block modification method 270 to exemplary flights 1 and 2 from Table 1.

TABLE 2

| | Flight 1 | Flight 2 |
|---|---|---|
| Average Scheduled Block (Mins.) | 56.1 | 74.4 |
| Average Block Difference when Actual Block > Scheduled Block (Mins.) | 19.3 | 12.9 |
| Modified Scheduled Block (Mins.) | 75.5 | 87.3 |

Table 3 illustrates application of block modification method 280 to exemplary flights 1 and 2 from Table 1.

TABLE 3

| | Flight 1 | Flight 2 |
|---|---|---|
| Average Actual Block (Mins.) | 62.5 | 77 |
| Standard Deviation of Actual Block (Mins.) | 18.9 | 14.9 |
| Modified Scheduled Block (Mins.) | 81.4 | 91.9 |

Table 4 illustrates application of block modification method 290 to the exemplary flights of Table 1, where $B_0$=65% is the input goal.

TABLE 4

| Minutes Added | Flight 1 ($B_0$) | Flight 3 ($B_0$) | Flight 3 ($B_0$) |
|---|---|---|---|
| 1 | 51.2% | 50.4% | 62.69% |
| 2 | 51.8% | 53.6% | 65.0% * |
| 3 | 52.9% | 56.2% | 66.7% |
| 4 | 54.2% | 59.8% | 67.8% |
| 5 | 54.8% | 63.1% | 69.7% |
| 6 | 55.7% | 65.6% * | 70.8% |
| 7 | 57.6% | 68.4% | 71.6% |
| 8 | 59.4% | 71.8% | 73.8% |
| 9 | 60.4% | 74.2% | 75.9% |
| 10 | 61.7% | 76.4% | 77.2% |
| 11 | 63.7% | 79.1% | 78.7% |
| 12 | 65.6% * | 80.0% | 79.3% |
| 13 | 67.1% | 81.8% | 80.6% |
| 14 | 69.2% | 83.3% | 81.9% |
| 15 | 69.9% | 84.9% | 83.4% |
| Average Scheduled Block (Mins.) | 56.1 | 74.4 | 168.2 |
| Modified Block (Mins.) | 68.1 | 80.4 | 170.2 |

* Goal level reached

As illustrated in Table 4, in various embodiments, method 290 or a similar goal-seeking algorithm may be utilized to determine a suitable number of minutes to add to a scheduled block time in order to achieve a desired $B_0$; the desired $B_0$ may be revised and/or updated, as desired (for example, responsive to changing regulatory guidelines, responsive to a revised cost target, responsive to changes in flight routes or physical infrastructure, and/or the like).

Table 5 illustrates comparative performance of block modification methods 270, 280, and 290 on exemplary historical data for one airline over a 4 month period.

TABLE 5

| | Total Line-holder Hours Added | Average Minutes Added Per Flight | $B_0$ | Improve-ment in $B_0$ | $B_0$ Improve-ment per Added Minute of Block Time |
|---|---|---|---|---|---|
| Baseline | N/A | N/A | 68.4% | N/A | N/A |
| Method 270 | 3083 | 10.51 | 87.4% | 19.0% | 1.8% |
| Method 280 | 3890 | 13.26 | 90.2% | 21.8% | 1.6% |
| Method 290 ($B_0$ goal = 74%) | 753 | 2.57 | 74.2% | 5.8% | 2.3% |

In operational reliability system 115, one or more of methods 270, 280, and/or 290 may be utilized in order to suggest or determine a revision to a scheduled block time for a flight or group of flights. Moreover, in various embodiments, operational reliability system 115 is configured to utilize a point of diminishing returns analysis when selecting a desired modified block time for a flight or group of flights. With momentary reference to FIG. 2F, in various embodiments, block adjustment module 146 is configured to determine the location on line 299 having a maximum slope. In one embodiment, block adjustment module 146 iteratively adds one minute to the average scheduled block time value, and calculates the resulting slope of line 299 at that point. Once slopes are calculated for a desired range of potential minutes added to the average scheduled block time (for example, from 1-20 minutes added), block adjustment module 146 determines the location having the maximum slope. This location may be considered to be the point of diminishing returns; additional increases in block time beyond this point result in reduced improvements in $B_0$ as compared to prior increases.

In various embodiments, operational reliability system 115 is configured to implement and/or suggest revisions to block times configured to achieve operation at or near the point of diminishing returns. In other embodiments, operational reliability system 115 is configured to implement and/or suggest revisions to block times configured to achieve operation above the point of diminishing returns, for example in order to achieve a reduced likelihood of a FAR 117 violation. In yet other embodiments, operational reliability system 115 is configured to implement and/or suggest revisions to block times configured to achieve operation below the point of diminishing returns, for example in order to implement an improvement to $B_0$ based on a particular (i.e. fixed or capped) expenditure of money.

Returning again to FIG. 2B, in various embodiments pairing optimizer 147 is configured to assess the output of block modification module 146. In one embodiment, block modification module 146 creates a schedule file (e.g., a modified SSIM file) for use in crew pairing optimization. For example, in various exemplary embodiments block modification module 146 receives a modified SSIM having modified block times as discussed hereinabove. Block modification module 146 may add the modified block times on a per-aircraft basis and evaluate the resulting effects for a particular time window into the future (for example, for one week going forward, two weeks going forward, one month going forward, etc). Block modification module 146 may thereafter incorporate one or more modified blocks into the modified SSIM file and pass the modified SSIM file to pairing uptimizer 147.

Returning again to FIG. 2B, in various embodiments, pairing optimizer 147 is configured to assess the output of block modification module 146. In certain embodiments, pairing optimizer 147 builds lineholder itineraries/crew pairings based on a modified SSIM file created by block modification module 146, for example by reconciling crew FAR rules, contractual work rules, and the like to the modified SSIM file. In various exemplary embodiments, the modified SSIM file created by pairing optimizer 147 is configured to be internal to an airline or subset thereof; for example, the modified SSIM file may not be public-facing or crew-facing. However, in certain embodiments pairing optimizer 147 may also reconcile lineholder itineraries with a flight schedule or other information provided to the public.

In certain exemplary embodiments, crew pairings prepared by pairing optimizer 147 via use of the modified SSIM file are re-joined to the original, unmodified SSIM file. The modified pairings incorporated into the unmodified SSIM file may be "locked" and thus prevented from further modification, for example by a subsequent optimization algorithm applied to the unmodified SSIM file. In this manner, operational reliability system 115 prevents "optimizing-out" the desirable pairings arising in consequence of the added buffer time.

It will be appreciated that crew pairings suggested by pairing optimizer 147 may be incorporated into the unmodified SSIM file in part or in whole.

It will be appreciated that in various embodiments, flight schedules visible to the public and/or visible to airline crew members do not change as a result of operation of operational reliability system 115; rather, back-end crew rule compliance evaluations (for example, compliance with FAR and with contractual requirements) are modified to account for the modified block times. Stated another way, crew itineraries do not change as a result of operation of operational reliability system 115 (i.e., a crew member schedule from city A→city B→city C remains the same), but the values a crew member accrues for compliance purposes are different.

Operational reliability system 115 enables improved risk allocation decisions and implementation. Viewed from a baseline cost and risk perspective, operational reliability system 115 allows modified and/or reduced risk levels compared to the baseline to be obtained for a known cost over the baseline cost; conversely, operational reliability system 115 also allows for operation at risk levels above the baseline for a known cost savings.

In operational reliability system 115, variables and parameters such as $B_0$ may be revised, adjusted, and/or modified, for example on a daily basis. Operational reliability system 115 can thus quickly respond to external factors influencing on-time performance (for example, widespread illness, civil unrest, labor disruptions, weather, equipment failures, and the like). It will be appreciated that as an organization's tolerance for risk decreases, the value of principles of the present disclosure (for example, use of operational reliability system 115) to that organization increases.

Principles and features of the present disclosure may suitably be combined with principles of revenue management, for example as disclosed in U.S. patent application Ser. No. 13/348,417 filed on Jan. 11, 2012 (now published as U.S. Patent Application Publication No. 2013-0132128 entitled "Overbooking, Forecasting, and Optimization Methods and Systems") which is incorporated herein by reference in its entirety.

Principles of the present disclosure may suitably be combined with principles of forecasting, demand modeling, and/or the like, for example as disclosed in U.S. patent application Ser. No. 13/791,672 entitled "Demand Forecasting Systems and Methods Utilizing Unobscuring and Unconstraining" filed on Mar. 8, 2013, U.S. patent application Ser. No. 13/791,691 entitled "Demand Forecasting Systems and Methods Utilizing Fare Adjustment" filed on Mar. 8, 2013, and U.S. patent application Ser. No. 13/791,711 entitled "Demand Forecasting Systems and Methods Utilizing Prime Class Remapping" filed on Mar. 8, 2013, each of which are incorporated herein by reference in their entirety.

Principles and features of the present disclosure may also suitably be combined with principles of reserve forecasting, for example as disclosed in U.S. patent application Ser. No. 13/793,049 entitled "Reserve Forecasting Systems and Methods" filed on Mar. 11, 2013, which is incorporated herein by reference in its entirety.

Principles and features of the present disclosure may also suitably be combined with principles of departure sequencing, for example as disclosed in U.S. patent application Ser. No. 13/833,761 entitled "Departure Sequencing Systems and Methods" filed on Mar. 15, 2013, which is incorporated herein by reference in its entirety.

Principles and features of the present disclosure may also suitably be combined with principles of misconnect management, for example as disclosed in U.S. patent application Ser. No. 13/837,462 entitled "Misconnect Management Systems and Methods" filed on Mar. 15, 2013, which is incorporated herein by reference in its entirety.

While the present disclosure may be described in terms of an airport, an aircraft, a pilot, and so forth, one skilled in the art can appreciate that similar features and principles may be applied to other transportation systems and vehicles such as, for example, buses, trains, ships, trucks, automobiles and/or the like.

While the exemplary embodiments described herein are described in sufficient detail to enable those skilled in the art to practice principles of the present disclosure, it should be understood that other embodiments may be realized and that logical and/or functional changes may be made without departing from the spirit and scope of the present disclosure. Thus, the detailed description herein is presented for purposes of illustration and not of limitation.

While the description references specific technologies, system architectures and data management techniques, practitioners will appreciate that this description is of various embodiments, and that other devices and/or methods may be implemented without departing from the scope of principles of the present disclosure. Similarly, while the description references a user interfacing with the system via a computer user interface, practitioners will appreciate that other interfaces may include mobile devices, kiosks and handheld devices such as mobile phones, smart phones, tablet computing devices, etc.

While the steps outlined herein represent exemplary embodiments of principles of the present disclosure, practitioners will appreciate that there are any number of computing algorithms and user interfaces that may be applied to create similar results. The steps are presented for the sake of explanation only and are not intended to limit the scope of the present disclosure in any way. Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all of the claims.

Systems, methods and computer program products are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to utilize such feature, structure, or characteristic in connection with other embodiments whether or not explicitly described. After reading the description, it will be apparent to one skilled in the relevant art(s) how to implement principles of the disclosure in alternative embodiments.

It should be understood that the detailed description and specific examples, indicating exemplary embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more." Moreover, when a phrase similar to "at least one of A, B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A method for increasing the efficiency of planning, scheduling and utilization of aircraft assets to reduce a risk of regulatory violation, comprising:

obtaining, by a processor configured for aircraft asset operational reliability within an operational reliability system, an aircraft block file comprising historical information for a plurality of aircraft flight groups, each aircraft flight group having a scheduled aircraft block time and a historical on-time aircraft performance $B_0$;

wherein the aircraft block file is obtained from an aircraft flight system, determining, by the processor, a modified aircraft block time for each respective aircraft flight group;

generating, by the processor, a modified aircraft block file containing the modified aircraft block time for each aircraft flight group; and determining, by the processor, the risk of aircraft regulatory violation associated with implementing an aircraft lineholder pairing, in accordance with the modified aircraft block time for the aircraft flight group.

2. The method of claim 1, further comprising utilizing, by the processor, a goal seeking algorithm to determining the modified aircraft block time for each aircraft flight group.

3. The method of claim 1, wherein the modified aircraft block time for each aircraft flight group is configured to cause the aircraft flight group to achieve a target on-time aircraft performance $B_0$.

4. The method of claim 1, wherein the determining, by the processor, the modified aircraft block time for each respective aircraft flight group further comprises:

obtaining, by the processor, a target on-time aircraft performance $B_0$ for each aircraft flight group;

determining, by the processor, a modified $B_0$ for each aircraft flight group, the modification associated with an increase in the modified aircraft block time for the aircraft flight group; and identifying, by the processor, the smallest modified aircraft block time sufficient to cause the modified $B_0$ to exceed the target $B_0$.

5. The method of claim 1, wherein the aircraft flight groups comprise aircraft flights selected based on aircraft departure station, aircraft arrival station, aircraft departure time, day of the week, and season.

6. The method of claim 1, further comprising providing, to an operational reliability system, the modified aircraft block time for each aircraft flight group for use as an input to a pairing optimizer.

7. The method of claim 1, further comprising determining, by the processor, an aircraft headcount impact associated with the modified aircraft block time for the aircraft flight group.

8. The method of claim 1, wherein the determining, by the processor, a modified aircraft block time for each respective aircraft flight group further comprises evaluating, for each aircraft flight group, an aircraft flight time buffer, an aircraft rest time buffer, and an aircraft duty time buffer, wherein the aircraft flight time buffer, the aircraft rest time buffer, and the aircraft duty time buffer are evaluated interdependently with one another.

9. A method, comprising:

obtaining, by a processor for operational reliability, an aircraft block file comprising historical information for a plurality of aircraft flight groups, each aircraft flight group having a scheduled aircraft block time and a historical on-time aircraft performance $B_0$;

determining, by the processor, a modified aircraft block time for each respective aircraft flight group; and generating, by the processor, a modified aircraft block file containing the modified aircraft block time for each aircraft flight group;

wherein the determining further comprises:

determining, by the processor, a line slope associated with a change in $B_0$ in connection with one minute incremental increases in the modified aircraft block time, the one minute incremental increases in the modified aircraft block time ranging from +1 to +20 minutes over the scheduled aircraft block time; and selecting, by the processor, the modified aircraft block time associated with the point on the line where the line slope has the largest magnitude.

10. A non-transitory computer-readable storage medium having computer-executable instructions stored thereon that, in response to execution by a processor configured for aircraft asset operational reliability within an operational reliability system, causes the processor to perform operations for increasing the efficiency of planning, scheduling and utilization of aircraft assets to reduce a risk of regulatory violation comprising:

obtaining, by the processor, an aircraft block file comprising historical information for a plurality of aircraft flight groups, each aircraft flight group having a scheduled aircraft block time and a historical on-time aircraft performance $B_0$;

wherein the aircraft block file is obtained from an aircraft flight system, determining, by the processor, a modified aircraft block time for each respective aircraft flight group;

generating, by the processor, a modified aircraft block file containing the modified aircraft block time for each aircraft flight group; and determining, by the processor, the risk of aircraft regulatory violation associated with implementing an aircraft lineholder pairing, in accordance with the modified aircraft block time for the aircraft flight group.

* * * * *